US009533321B2

(12) United States Patent
Yu

(10) Patent No.: US 9,533,321 B2
(45) Date of Patent: Jan. 3, 2017

(54) SPRAY GUN

(71) Applicant: Pin-Hsien Yu, Taipei (TW)

(72) Inventor: Pin-Hsien Yu, Taipei (TW)

(73) Assignee: AQUALEAN MANUFACTURING ASSOCIATES CO., LTD., Taipei (TW)

( * ) Notice: Subject to any disclaimer, the term of this patent is extended or adjusted under 35 U.S.C. 154(b) by 171 days.

(21) Appl. No.: 14/456,466

(22) Filed: Aug. 11, 2014

(65) Prior Publication Data

US 2015/0060569 A1 Mar. 5, 2015

(30) Foreign Application Priority Data

Sep. 4, 2013 (TW) ..... 102216598 U

(51) Int. Cl.

| | |
|---|---|
| ***A62C 31/02*** | (2006.01) |
| ***B05B 9/00*** | (2006.01) |
| ***B05B 7/14*** | (2006.01) |
| ***B05B 9/01*** | (2006.01) |
| ***B05B 1/30*** | (2006.01) |
| ***B05B 12/00*** | (2006.01) |
| *B05B 1/16* | (2006.01) |

(52) U.S. Cl.

CPC ..... *B05B 9/01* (2013.01); *B05B 1/3026* (2013.01); *B05B 12/002* (2013.01); *B05B 1/169* (2013.01)

(58) Field of Classification Search

CPC ..... B05B 9/01; B05B 12/002; B05B 1/3026; B05B 1/169; B05B 1/12

USPC ..... 239/393, 395, 391, 392; 251/325, 319

See application file for complete search history.

(56) References Cited

U.S. PATENT DOCUMENTS 2,726,120 A * 12/1955 Bletcher ..... B05B 1/18 239/449
3,189,049 A * 6/1965 Carlson ..... F16K 11/0716 137/625.24
3,258,026 A * 6/1966 Weaver ..... F16K 3/26 137/375
3,632,083 A * 1/1972 Meeks ..... A61C 17/0202 251/282
3,682,392 A * 8/1972 Kint ..... E03C 1/08 137/625.5
3,722,798 A * 3/1973 Bletcher ..... E03C 1/084 137/625.5
3,847,371 A * 11/1974 Norton ..... F16K 31/08 251/319
4,457,341 A * 7/1984 Aspinwall ..... F15B 13/0402 137/614.17
5,172,866 A * 12/1992 Ward ..... B05B 1/1663 239/446
5,522,796 A * 6/1996 Dorsey, III ..... A61M 1/0064 137/596.2

(Continued)

*Primary Examiner* — Arthur O Hall
*Assistant Examiner* — Steven M Cernoch
(74) *Attorney, Agent, or Firm* — Egbert Law Offices, PLLC

(57) ABSTRACT

A spray gun includes a handle and a spray head mounted to each other for forming a hollow main body. A switching assembly is mounted in the main body between the handle and the spray head for controlling the operating type of the spray gun. The switching assembly includes a seat mounted in the main body, a shank extending through the seat, an outlet set received in the seat, a first button and a second button, wherein the first button and the second button are respectively connected two a front end and a rear end of the shank.

3 Claims, 5 Drawing Sheets

(56) References Cited

U.S. PATENT DOCUMENTS 6,254,061 B1 * 7/2001 Levine ..... A61B 1/00135 251/322
6,276,659 B1 * 8/2001 Wang ..... F16K 31/365 251/230
6,352,212 B1 * 3/2002 Wang ..... F16K 7/16 239/390
6,508,415 B2 * 1/2003 Wang ..... B05B 15/066 239/526
6,557,587 B1 * 5/2003 Chiu ..... E03C 1/04 137/801
6,659,373 B1 * 12/2003 Heren ..... B05B 1/3013 239/391
6,685,110 B2 * 2/2004 Wang ..... F16K 7/16 239/525
6,722,391 B2 * 4/2004 Gabrel ..... G05D 16/10 137/505.42
6,915,967 B1 * 7/2005 Chen ..... B05B 1/3013 239/525
7,159,797 B1 * 1/2007 Lammers ..... B05B 15/065 239/390
7,201,332 B2 * 4/2007 Wang ..... B05B 1/3013 239/525
7,240,858 B2 * 7/2007 Wang ..... B05B 1/3013 239/395
7,370,814 B2 * 5/2008 Chih ..... B05B 1/1645 239/391
7,380,731 B1 * 6/2008 Hsu ..... B05B 1/1618 239/391
7,527,239 B2 * 5/2009 Mau ..... F16K 1/12 239/526
8,177,147 B2 * 5/2012 Engel ..... B05B 1/1654 239/393
8,297,538 B2 * 10/2012 Zhou ..... B05B 1/1636 239/391
8,424,781 B2 * 4/2013 Rosko ..... B05B 1/1609 239/446
9,044,767 B2 * 6/2015 Zhu ..... B05B 1/3026
2005/0258274 A1 * 11/2005 Wang ..... B05B 1/1636 239/393
2006/0237559 A1 * 10/2006 Chih ..... B05B 1/1654 239/394
2011/0233439 A1 * 9/2011 Lee ..... F16K 31/60 251/319

* cited by examiner

SPRAY GUN

CROSS-REFERENCE TO RELATED U.S. APPLICATIONS

Not applicable.

STATEMENT REGARDING FEDERALLY SPONSORED RESEARCH OR DEVELOPMENT

Not applicable.

NAMES OF PARTIES TO A JOINT RESEARCH AGREEMENT

Not applicable.

REFERENCE TO AN APPENDIX SUBMITTED ON COMPACT DISC

Not applicable.

BACKGROUND OF THE INVENTION

1. Field of the Invention

The present invention relates to a spray gun, and more particularly to a spray gun that includes a switching assembly mounted therein for easy operation.

2. Description of Related Art Including Information Disclosed under 37 CFR 1.97 and 37 CFR 1.98

A spray gun is usually used for gardening and spraying water on flowers and plants. A conventional spray gun is connected to a water source and sprays various sprays by a spray head thereof.

A conventional spray gun in accordance with the prior art includes a handle and a spray head mounted to each other. A trigger is mounted on the handle such that the water is sprayed when the trigger is pressed. The type of conventional gun has been widely used for several years. The user's palm may be numb after operating the conventional spray gun for a period of time because the trigger must be continually pressed during spraying of water. As a result, the convenience, the comfort and the smoothness of the conventional spray gun are weak such that the conventional spray gun needs to be advantageously altered.

The present invention has arisen to mitigate and/or obviate the disadvantages of the conventional spray gun.

BRIEF SUMMARY OF THE INVENTION

The main objective of the present invention is to provide an improved spray gun that can be easily and comfortably operated.

To achieve the objective, the spray gun in accordance with the present invention comprises a main body including a handle and a spray head mounted to each other, wherein the handle and the spray are hollow structures such that a passage is defined in the main body. A T-shaped receiving portion is defined in a top portion of the handle and an opening is defined in a bottom of the receiving portion, wherein the opening communicates with the passage. The handle has a lower end adapted to be connected to a water source to allow the water flowing into the passage. A switching assembly is mounted in the main body between the handle and the spray head for controlling the operating type of the spray gun. The switching assembly comprises a seat mounted in the main body and partially received in the receiving portion in the handle. The seat has a through hole defined therein and communicating with the passage in the main body. Two tubes respectively extend from the seat and each tube has a tunnel defined therein, wherein the two tunnels linearly correspond to each other and communicates with the through hole in the seat. A shank extends through the seat via the two tunnels and is reciprocally movable relative to the seat. A first through hole is diametrically defined in the shank and selectively communicates with the through hole. A first button and a second button are respectively mounted onto a front end and a rear end of the shank. The first button and the second button alternately extend out of the main body for user to easily controlling the operating type of the spray gun.

Further benefits and advantages of the present invention will become apparent after a careful reading of the detailed description with appropriate reference to the accompanying drawings.

DETAILED DESCRIPTION OF THE INVENTION

Figure 1:
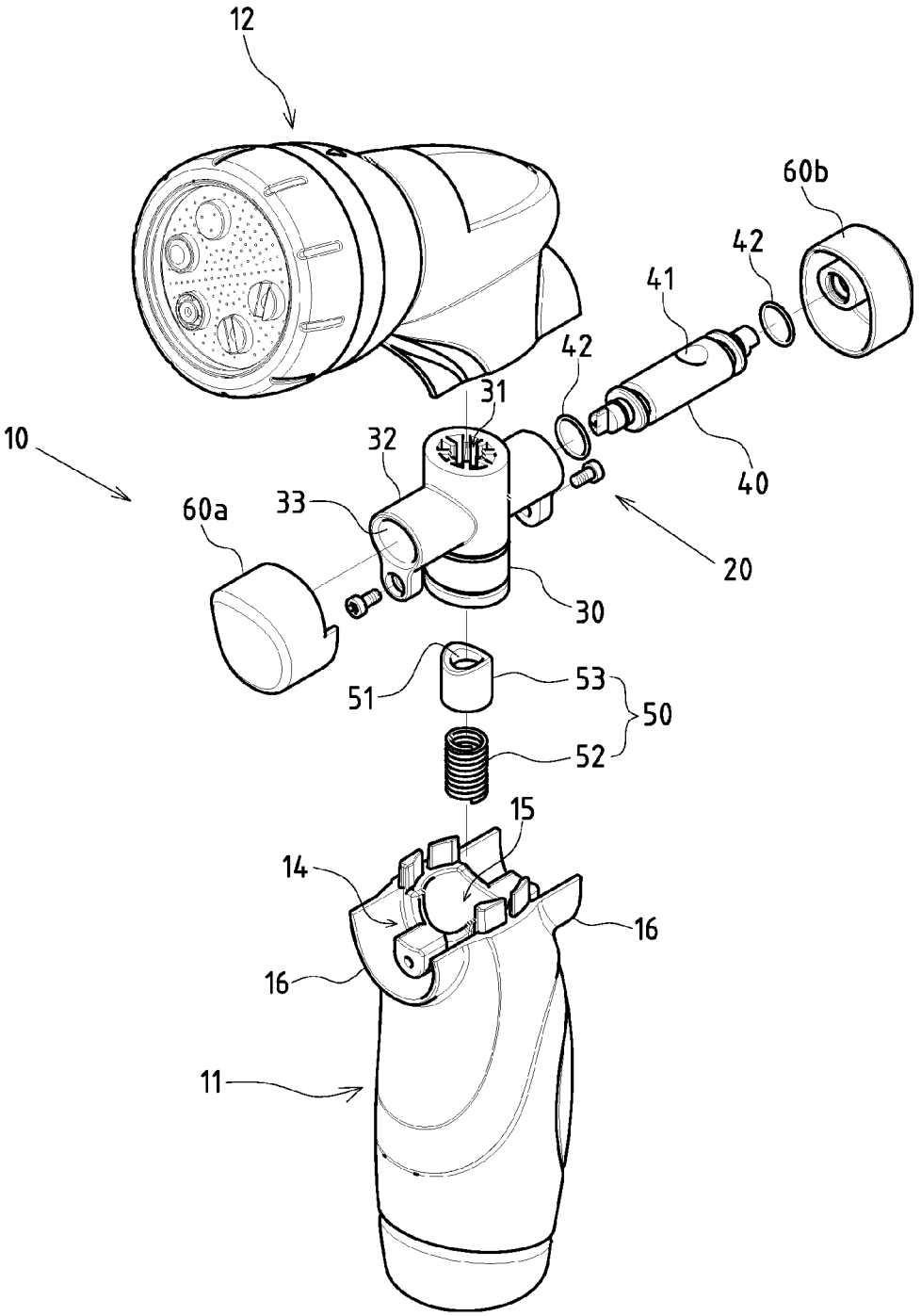
FIG. 1 is an exploded perspective view of a spray gun in accordance with the present invention.
Figure 2:
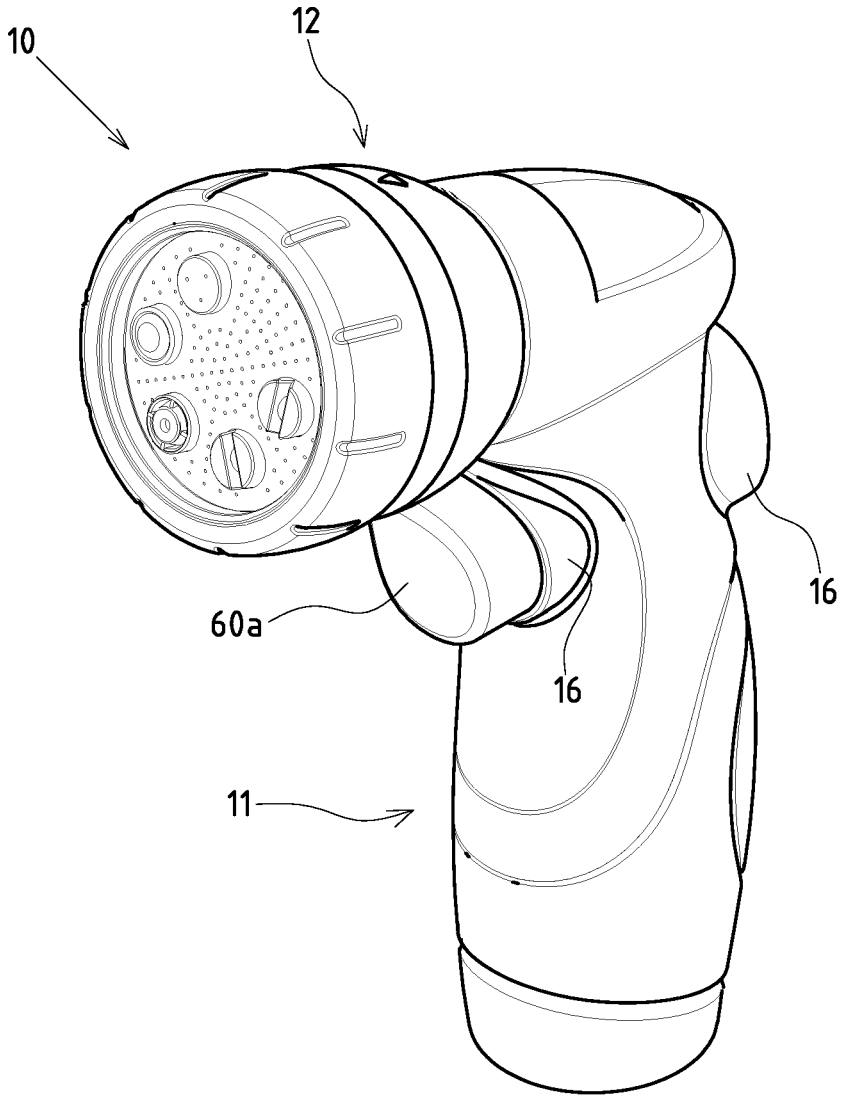
FIG. 2 is a perspective view of a spray gun in accordance with the present invention.
Figure 3:
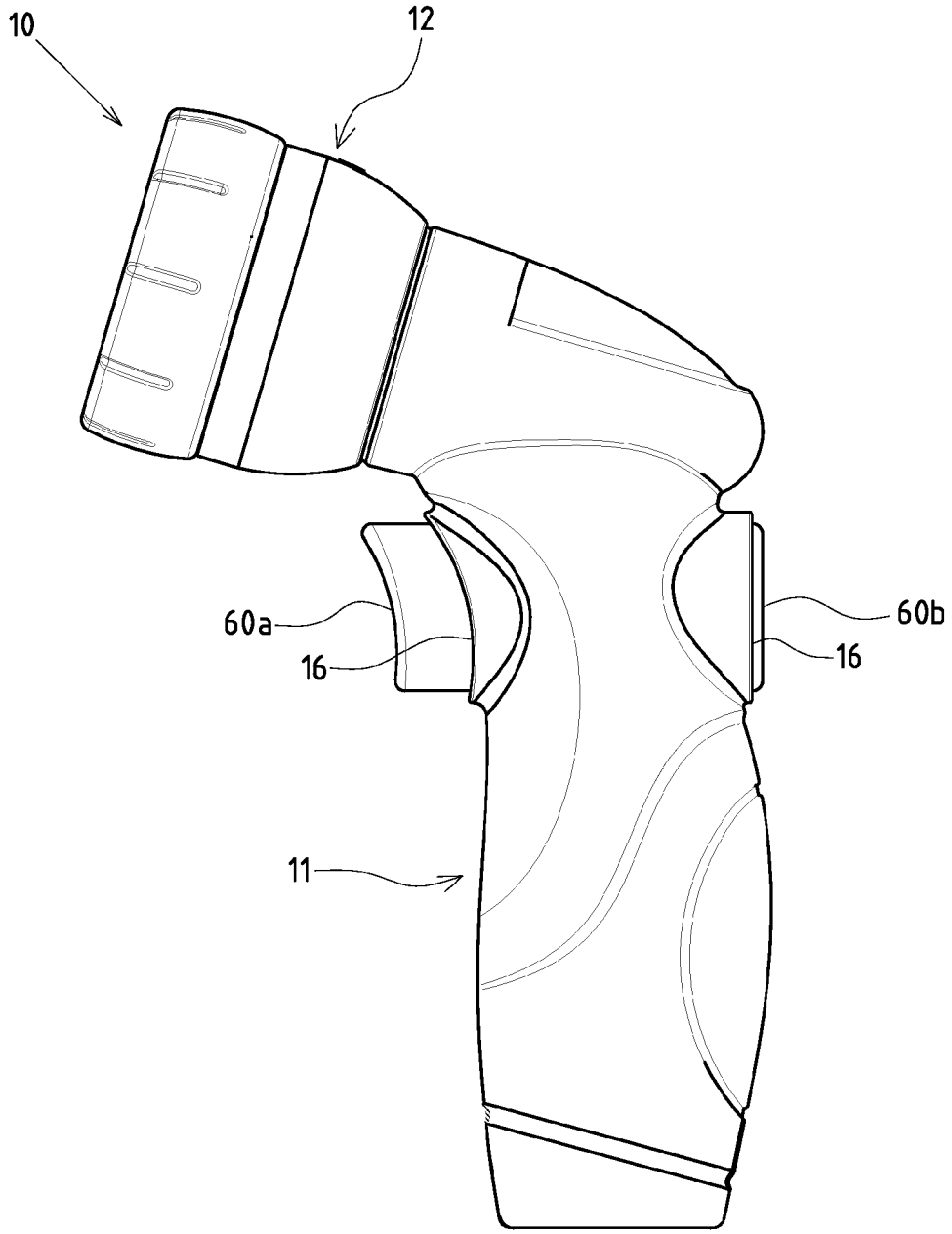
FIG. 3 is a side plan view of the spray gun in FIG. 2.

With reference to FIGS. 1, 2 and 3, the spray gun in accordance with the present invention comprises a main body 10 including a handle 11 and a spray head 12 mounted to each other, wherein the spray head 12 can provide various spray types. The handle 11 and the spray 12 are hollow structures such that a passage 13 is defined in the main body 10. A T-shaped receiving portion 14 is defined in a top portion of the handle 11 and an opening 15 is defined in a bottom of the receiving portion 14, wherein the opening 15 communicates with the passage 13. The handle 11 has a lower end adapted to be connected to a water source to allow the water flowing into the passage 13.

A switching assembly 20 is mounted in the main body 10 between the handle 11 and the spray head 12 for controlling the operating type of the spray gun.

Figure 4:
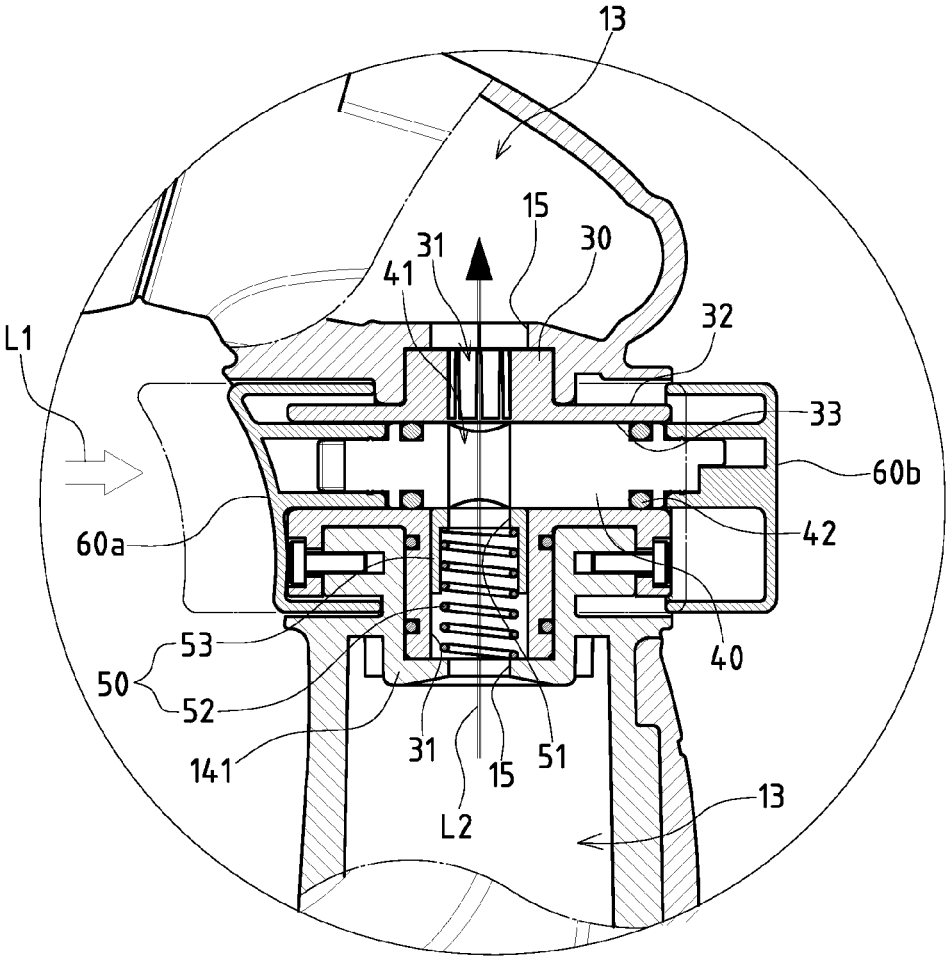
FIG. 4 is a cross-sectional operational view of the spray gun in FIG. 2 when spraying.

With reference to FIGS. 3 and 4, the switching assembly 20 includes a seat 30 mounted in the main body 10, a shank 40 extending through the seat 30, an outlet set 50 received in the seat 30, a first button 60*a* and a second button 60*b*, wherein the first button 60*a* and the second button 60*b* are respectively connected two a front end and a rear end of the shank 40.

The seat 30 is partially received in the receiving portion 14 in the handle 11 and inserted into the passage 13 through the opening 15. A through hole 31 is defined in the seat 30 and communicates with the passage 13 in the main body 10. Two tubes 32 respectively extend from the seat 30 and each tube 32 has a tunnel 33 defined therein, wherein the two tunnels 33 linearly correspond to each other and respectively communicate with the through hole 31 in the seat 30.

The shank 40 extends through the seat 30 via the two tunnels 33 and is reciprocally movable relative to the seat 30. The shank 40 has a first through hole 41 diametrically defined therein and selectively communicating with the through hole 31. Two sealing elements 42 are respectively sleeved on two opposite ends of the shank 40 such that an air-tight relation is formed between the shank 40 and the seat 30.

Figure 5:
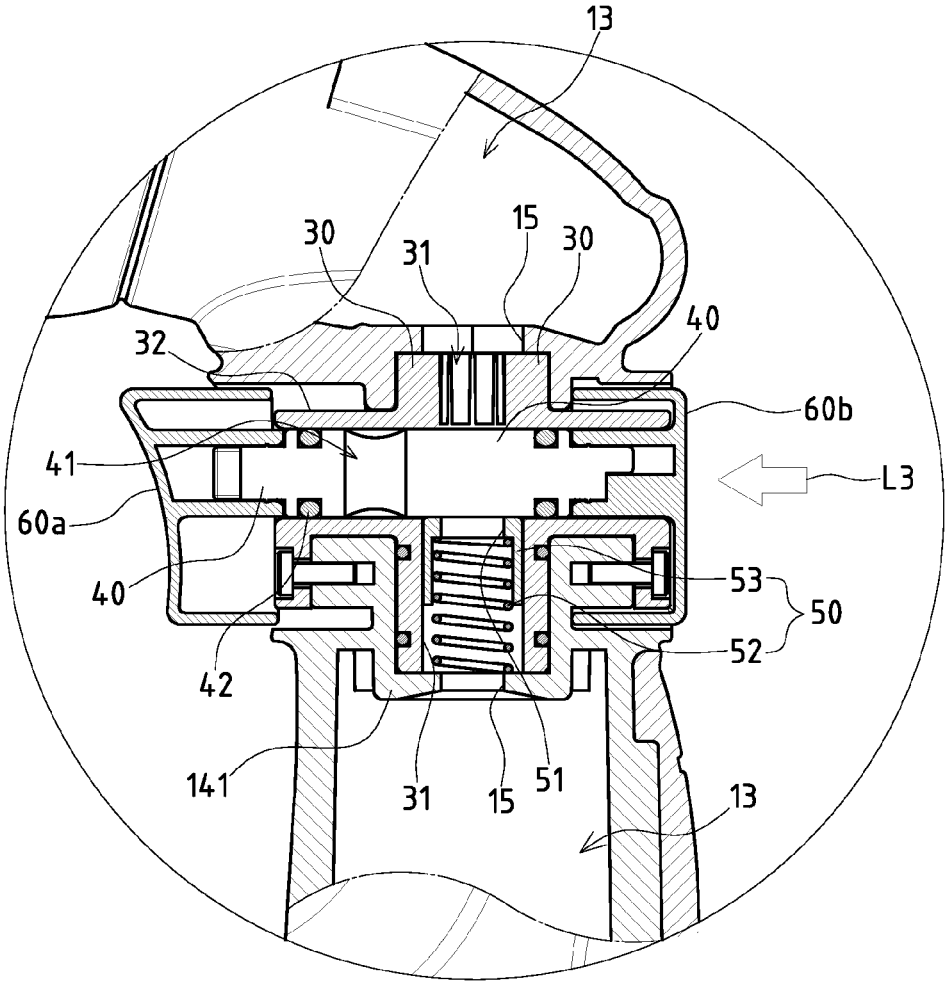
FIG. 5 is a cross-sectional operational view of the spray gun in FIG. 2 when the passage in the spray gun is closed.

With reference to FIGS. 4 and 5, the handle 11 has a stopper 141 inwardly extending from an inner periphery of a lower portion of the receiving portion 14. The outlet set 50 includes a spring 52 and a tubular element 53 sequentially mounted into the through hole 31 in the seat 30, wherein the spring 52 has two opposite ends respectively abutting against the stopper 141 and the tubular element 53 such that the tubular element 53 securely abuts the shank 40. A second through hole 51 is defined in the tubular element 53 and selectively communicates with the first through hole 41 in the shank 40. In the preferred embodiment of the present invention, the tubular element 53 is made of flexible material, such as rubber, for air tightly abutting against the shank 40.

The first button 60*a* and the second button 60*b* are respectively attached to a front end and a rear end of the shank 40 for operator to easily moving the shank 40 relative to the main body 10. The through hole 31, the second through hole 51 and the first through hole 41 sequentially communicate with one another when the shank 40 is backwardly pushed by the first button along the arrow L1 in FIG. 4. Consequently, the water is sprayed out of the spray head 12 along the arrow L2 in FIG. 4 after flowing through the through hole 31, the second through hole 50 and the first through hole 41. The water source is blocked and the spray head 12 stop to spray water when the shank 40 is forwardly pushed by the second button 60*b* along the arrow L3 in FIG. 5 and the second through hole 51 does not communicate with the first through hole 41. As described above, the first button 60*a* and the second button 60*b* alternately extend out of the main body 10 for user to easily operate the shank 40.

With reference to FIGS. 1 and 3, the handle 11 has two curved protrusions 16 extending therefrom and linearly corresponding to each other for supporting the first button 60*a* and the second button 60*b*.

By the assemblies described hereinbefore, the user can easily change the conditions of blocked and communicated only by pushing the first button 60*a*/second button 60*b*. As a result, the user does not need to continually press the trigger of the conventional spray gun such that the user's palm is not numb after operating the spray gun in accordance with the present invention for a period of time. Consequently, the spray gun in accordance with the present invention is more comfortable and convenient relative to the conventional spray gun in accordance with the prior art.

Although the invention has been explained in relation to its preferred embodiment, it is to be understood that many other possible modifications and variations can be made without departing from the spirit and scope of the invention as hereinafter claimed.

I claim:

1. A spray gun apparatus comprising: a main body having a handle and a spray head mounted to each other, each of said handle and said spray head being a hollow structure so as to define a passage in said main body, said handle having a T-shaped receiving portion defined in a top portion thereof, said T-shaped receiving portion having an opening defined in a bottom thereof, said opening communicating with said passage, said handle having a lower end adapted to be connected to a water source so as to allow water to flow into said passage; and a switching assembly mounted to said main body between said handle and said spray head, said switching assembly comprising: a seat mounted in said main body and partially received in said T-shaped receiving portion, said seat having a through hole defined therein, said through hole communicating with said passage of said main body, said seat having a pair of tubes extending therefrom, each tube of said pair of tubes having a tunnel defined therein, the tunnels linearly corresponding to each other and communicating with said through hole of said seat; a shank extending through said seat via the tunnels, said shank having a first through hole diametrically defined in said seat, said first through hole selectively communicating with said through hole of said seat; a first button and a second button respectively mounted onto a front end and a rear end of said shank, said first button and said second button alternately extending out of said main body; and an outlet set positioned in said through hole of said seat, said outlet set having a second through hole which selectively communicates with said first through hole, said first through hole and said second through hole communicating with each other when said first button is pushed backwardly, said handle having a stopper extending inwardly from an inner periphery of a lower portion of said receiving portion, said outlet set having a spring and a flexible tubular element sequentially mounted into said through hole of said seat, said spring having opposite ends respectively abutting against said stopper and said tubular element such that said tubular element abuts said shank.

2. The spray gun apparatus of claim 1, said handle having a pair of curved protrusions that support said first button and said second button.

3. The spray gun apparatus of claim 1, said shank having a pair of sealing elements respectively sleeved on opposite ends of said shank, said pair of sealing elements forming an air-tight relation between said shank and said seat.

* * * * *